United States Patent [19]

Herchenbach

[11] Patent Number: 4,558,955

[45] Date of Patent: Dec. 17, 1985

[54] WRIST WATCH

[75] Inventor: Wolfgang Herchenbach, Pforzheim, Fed. Rep. of Germany

[73] Assignee: Rodi & Wienenberger AG, Pforzheim, Fed. Rep. of Germany

[21] Appl. No.: 598,573

[22] Filed: Apr. 9, 1984

[30] Foreign Application Priority Data

Apr. 16, 1983 [DE] Fed. Rep. of Germany ... 8311399[U]
Nov. 22, 1983 [DE] Fed. Rep. of Germany ... 8333431[U]

[51] Int. Cl.[4] ..... G04B 37/00

[52] U.S. Cl. ..... 368/282; 368/294; 368/296; 368/309

[58] Field of Search ..... 368/294, 296, 282, 295

[56] References Cited

U.S. PATENT DOCUMENTS

| | | | |
|---|---|---|---|
| 4,241,442 | 12/1980 | Grohoski | 368/294 |
| 4,462,697 | 7/1984 | Thompson | 368/282 |
| 4,473,306 | 9/1984 | Lederrey | 368/296 |

FOREIGN PATENT DOCUMENTS

| | | | |
|---|---|---|---|
| 041481 | 9/1981 | European Pat. Off. | 368/294 |
| 98660 | 1/1984 | European Pat. Off. | 368/294 |
| 2452479 | 5/1975 | Fed. Rep. of Germany . | |
| 2733094 | 2/1979 | Fed. Rep. of Germany . | |
| 2836827 | 3/1980 | Fed. Rep. of Germany . | |
| 3043263 | 7/1982 | Fed. Rep. of Germany . | |
| 3116306 | 11/1982 | Fed. Rep. of Germany . | |
| 864164 | 4/1941 | France | 368/296 |
| 134378 | 10/1980 | Japan | 368/296 |
| 207376 | 10/1939 | Switzerland | 368/296 |
| 336017 | 3/1959 | Switzerland | 368/294 |
| 639813 | 12/1983 | Switzerland | 368/282 |

*Primary Examiner*—Bernard Roskoski
*Attorney, Agent, or Firm*—Michael J. Striker

[57] ABSTRACT

A wrist watch in which only a lower case portion is provided, onto which a watch glass is pressed. The watch glass is formed of two discs, one positioned on the other. Two discs are glued to each other and are assembled to form steps therebetween. The watch strap has two end portions provided with projections engaged in the above steps of the watch glass.

18 Claims, 4 Drawing Figures

WRIST WATCH

BACKGROUND OF THE INVENTION

The present invention relates to a wrist watch including a can-shaped lower case portion in which a clockwork is received and a watch glass is pressed onto that lower case portion with interposition of a seal ring.

Various watch systems are known, in which individual components of the wrist watch are inserted from above into the lower case portion and the watch is locked by means of a bezel and/or the watch glass.

The German patent publication 24 52 479 discloses a watch case formed of one sheet of material. The watch glass in this instance is held in the case by means of a bezel, two fastening claws and two fastening supports. Each fastening support is provided at its lower end with a thread onto which a nut is screwed. The bottom and the bezel of the watch case are connected to each other by those nuts. The disadvantage of this watch case is that it contains too many structural parts and is therefore expensive in manufacturing. Furthermore, if a fastening of the watch strap to this watch case, by means of known spring webs, takes place these spring webs should be inserted between corresponding connecting strips formed on the lower portion of the watch case. A smooth, harmonic transition from the watch case to the watch strap is then impossible.

German Offenlegunsschrifts 30 43 263 and 31 16 306 disclose a wrist watch which is comprised of relatively few simple structural components and in which due to the specific structure of the fastening arrangement for the watch strap a harmonic watch unit is formed. However, in these known constructions the screwed-on bezel is still utilized to ensure the proper holding of the watch strap.

Watch cases have been known, in which the watch glass has been connected immediately to the case without the use of a bezel. Such a watch case has been described, for example in German Offenlegunsschrift 28 36 827. The watch case shown in this German publication is a completely closed box which has on the front side thereof only a narrow opening which serves as a passage for the hour and second hand shafts. The watch glass in this watch covers the entire front side of the case box and is connected to the case box by screws. The watch strap is fastened to the case in the known fashion by means of connecting webs or strips projected outwardly from the case at two opposite sides thereof so that a clearance between the case and the watch strap is formed whereby the case does not harmonically merge into the strap.

Still another structure of the watch case has been known, in which the upper frame of the case which receives the clockwork and supporting the glass, has laterally projected flanges, on each of which a web rests, forming one portion of the watch strap, and in which those flanges lie on the bottom portion of the case and are connected thereto by bolts, screws or rivets. Such a structure is described in German Offenlegunsschrift 27 33 094. The disadvantage of this known construction is that the webs, proposed in the fastening arrangement for the watch strap are, at least partly, surrounded by the strap formed of leather, plastics or textile material, or, in case of a metal or link strap, should be connected to the strap by pins, screws, rivets or bolts. This requires additional manufacturing steps so that the cost of the watch is increased. Furthermore, the provision of the upper frame of the case with two flanges in which cheeks are formed and on which the end portions of the watch strap are laid from above and providing various bores for receiving fastening screws and pins as well as recesses for necessary seals, makes the manufacturing very complex and troublesome so that the watch altogether is expensive and its manufacturing is inefficient.

Usually plastic glass or mineral glass is utilized for manufacturing watch glasses. In the case of wrist watches of the higher price range often a watch glass made of sapphire glass is used for reasons of its durability. In order to improve an aesthetic appearance of the watch and provide for greater design possibilities the watch glasses have been partially metallized or covered with a contrast material.

The above mentioned glass materials, however, have some disadvantages. Plastics glass is very soft so that it soon becomes scratched and thereby loses nice appearance and satisfactory optical visibility. Mineral glass is substantially harder and durable but the wearing properties of this glass are not completely satisfactory. Sapphire glass has proved to have specifically high resistance to scratching and durability but it is relatively expensive.

SUMMARY OF THE INVENTION

It is an object of the present invention to provide an improved wrist watch.

It is another object of the invention to provide a wrist watch corresponding to modern trend and which could be manufactured and assembled of a few simple and inexpensive structural component parts. The transition from the watch case to the watch strap in the watch according to the invention must be smooth and have no interruption so that the watch case and the strap are combined in one harmonic unit. Furthermore, the wrist watch of the invention is provided with the glass which has optimal wearing qualities and which is inexpensive in manufacturing so that such a glass may advantageously be used also for wrist watches of the lower price range.

These and other objects of the invention are attained by a wrist watch comprising a lower case portion of a pot-like shape; a clockwork received in said portion; a watch glass; a seal ring, said watch glass being pressed against said lower case portion with interposition of said seal ring; and watch strap having two end portions connected to said lower case portion, said watch glass being held and pressed against said lower case portion directly by said two end portions of the watch strap, so that the upper case portion is no longer required.

The watch glass may have two opposite sides and be provided at said opposite sides with opposite lateral steps, said two end portions having two respective projections, which are engaged in said lateral steps, respectively.

The watch glass may be formed with an opening which constitutes a space for an hour and second hand.

The height of each of the lateral steps may be the same as the height of said space.

The glass may be formed of a lower disc and an upper disc positioned on said lower disc and glued thereto.

The lower disc may be formed with said opening and laterally extend at each said opposite side of the glass beyond said upper disc a distance corresponding to the width of each lateral step.

The upper disc and the lower disc of said glass may be formed of different materials having different hardnesses.

In another embodiment the upper disc may be formed of sapphire glass and the lower disc may be formed of metal.

The glass at the underside of the lower disc or preferably on the under side of the upper disc in the region of the glue joint between the two discs may be decorated, for example metallized or varnished.

The lower case portion may be provided with a recess extended up to said space, the watch including a dial positioned in said recess, the aforementioned seal ring being also positioned in said recess and surrounding the dial, the lower disc having an inner rim overlapping an edge of the dial.

The watch may further include a crown stem detachably connectable to the clockwork by means of a coupling, and at least two additional seal rings, said lower casing portion including a bore receiving the crown stem, said crown stem being guided immediately in said bore and having at least two grooves formed thereon, said additional seal rings being carried by said crown stem at those grooves.

In one of the embodiments the upper disc may be formed of sapphire glass and the lower disc may be formed of mineral glass.

The specific advantage of the wrist watch according to the invention resides in that the quantity of structural components in the watch is further reduced. The individual component parts of the watch are so constructed that they are rationally manufactured and assembled. The transition from the watch itself to the watch strap is smooth and has no gaps. The height of the lower disc of the watch glass defines the height of the space for the hour and second hands.

Due to the combination of the sapphire glass with the mineral glass or metal a watch glass is produced the price of which is much lower than the price of conventional glasses made only of sapphire, this combined glass, however has the same wearing properties as the glass formed completely of sapphire. In the two-piece watch glass the lower piece or disc may be formed of inexpensive but stable mineral glass or inexpensive metal without jeopardizing the wearing properties of the glass because during the usage of the watch the lower disc is not exposed to any stress.

The design possibilities of the wrist watch according to the invention are tremendous due to the forming of the glass of two pieces and decorating of the glued surface between the two discs. Owing to the combination of the transparent sapphire glass for the upper disc and metal for the lower disc numerous design possibilities can be found for the aesthetic appearance of the wrist watch in which the watch glass can be selected not only depending upon the metal to be used for the lower disc but also upon the shape of the opening in the lower disc, which can be round, rectangular, square, etc. Further, a plurality of various combinations of different colours can be used for the dial, and different treatment methods for the glass dial and strap could be utilized.

The dial and the seal ring lie in a flat milled recess of the lower case portion. Thus a bothersome alignment or insertion of the seal ring into narrow grooves is no longer required. The seal ring is inserted into the interior of the case from above and covered or overlapped by the rim of the lower disc and therefore is not seen from outside.

Since the shape of the recess or opening in the lower case portion for receiving the clockwork coincides with the contour of the clockwork the adjustment of the clockwork in the case is problemless. The above mentioned axletree is inserted into the case after its assembling has been completed. This axletree requires only one smooth bore for passing the axletree toward the clockwork because the seal rings are positioned directly on the axletree. If necessary the seal rings can be easily interchanged without diassembling of the watch. Preferably, two seal rings are mounted on the axletree because this improves the sealing of the interior of the watch and ensures the guidance of the axletree within the aforementioned bore.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
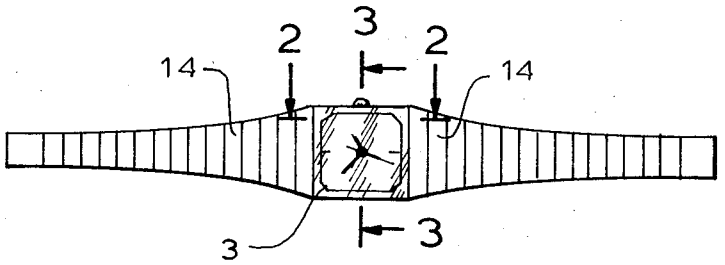
FIG. 1 is a top plan view of the wrist watch according to the invention.
Figure 2:
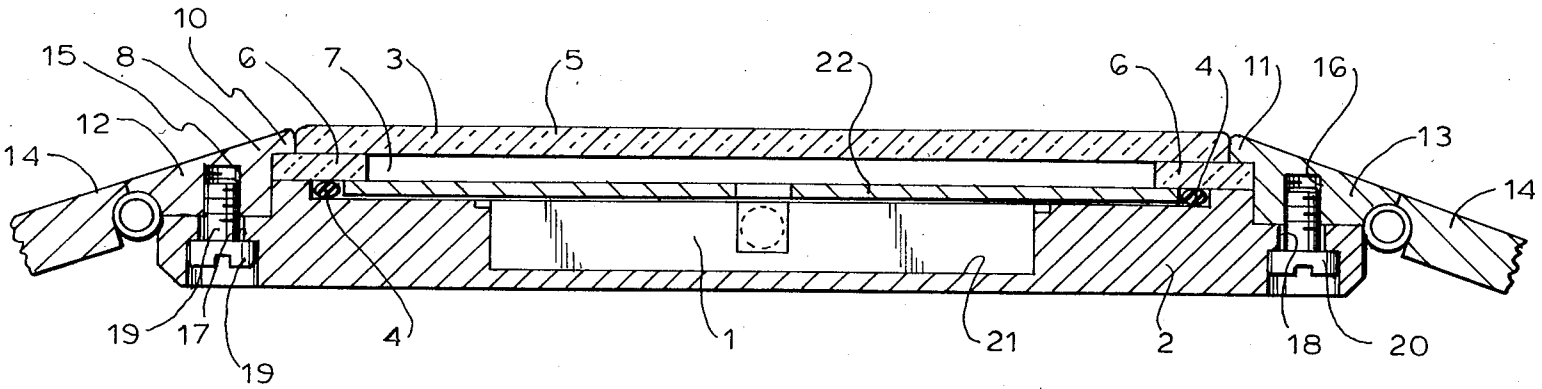
FIG. 2 is a sectional view taken along line II—II of FIG. 1.
Figure 4:
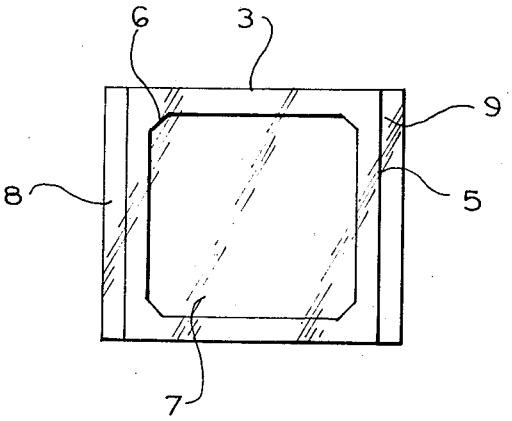
FIG. 4 is a top plan view of a two-piece watch glass.

Referring now to the drawings in detail, and firstly to FIGS. 1 and 2 thereof, the wrist watch includes a lower case portion 2 which has the shape of a pot or can and provided with a recess 21 in which a clockword 1 is received. The clockwork 1 is conventional and is not therefore descrbed herein in detail. A watch glass 3 superimposed on the lower case portion 2 is pressed against the case portion 2 with the interposition of a seal ring 4. The watch glass 3 as also shown in FIG. 4 is comprised of two discs 5 and 6 superimposed on each other in a sandwich-like fashion. The lower disc 6 of the watch glass has an opening 7 which serves as a space for an hour hand and a second hand of the watch. The sandwich-like watch glass thus has at two opposite sides thereof two steps 8 and 9 formed between the upper disc 5 and lower disc 6. Projections 10 and 11 of two opposite end portions 12 and 13 of the halves of wrist watch strap 14 are engaged in lateral steps 8 and 9, respectively. The height of each step 8, 9 formed by disc 6 corresponds to the height of opening 7. The end portions or pieces 10, 11 have threaded bores 15, 16 while the lower case portion 2 has corresponding through bores 17 and 18. Bolts 19, 20 are inserted in those bores and secured therein. Upon screwing of bolts 19, 20 in bores 15, 16, 17, 18 the watch glass 3 and lower case portion 2 are fastened to each other, whereby the end portions 12, 13, which serve as a glass holding means, and the glass 3 will be pressed against the lower case portion 2.

The case portion 2 is formed with recess 21 as mentioned above, which receives the clockwork 1. The shape of recess 21 corresponds to the contour of the clockwork 1. A dial 22 applied above the clockwork 1 is positioned in a milled circular recess 23 in which seal ring 4 is located. The inner rim of watch glass 3, namely the rim of disc 6 thereof, overlaps the rim or edge of dial 22 and therefore holds it inside.

Figure 3:
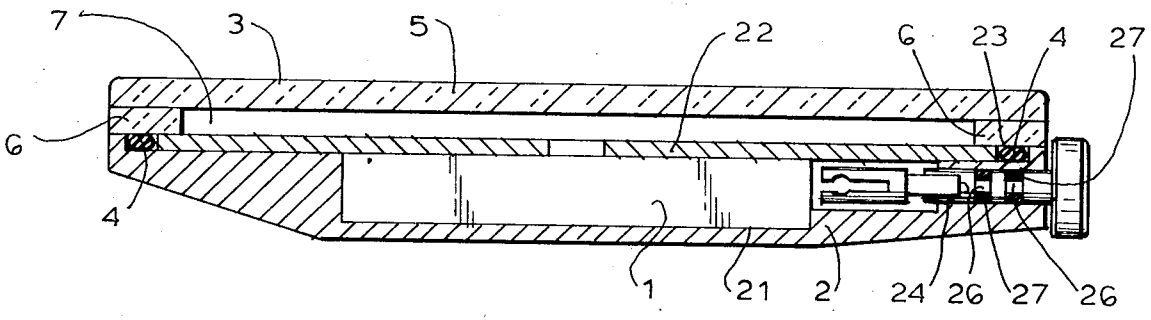
FIG. 3 is a sectional view taken along line III—III of FIG. 1.

With reference to FIG. 3 it can be observed that case portion 2 is provided with a lateral bore 24 in which an crown stem 25 is inserted which can be arrested in the bore 24 in the known fashion by means of a coupling connected to the shaft of the clockwork 1 or pulled out from that bore. The crown stem 25 has two grooves 26 formed on the surface thereof and spaced from each other along the axis of the crown stem 25. Seal rings 27 are positioned in those grooves 26. The seal rings 27 press against the inner wall forming the bore 24 and seal that bore 24 against the entrance of dust and moisture.

The watch glass 3 as has been described hereinabove is formed of two discs 5 and 6. The upper disc 5 is made out of sapphire glass and is glued to the lower disc 6 which is formed, for example of mineral glass.

FIG. 4 shows the top plan view of the watch glass of another embodiment. The upper disc 5 is here formed also of transparent sapphire glass whereas the lower disc 6 is made of metal which provides for a special decorative effect for watch glass 3. The underside of disc 6 or the underside of disc 5 in the region in which it is attached, e.g. glued to disc 6 can be covered with varnish. If disc 6 is made out of glass its underside may be covered with metal.

It will be understood that each of the elements described above, or two or more together, may also find a useful application in other types of wrist watches differing from the types described above.

While the invention has been illustrated and described as embodied in a wrist watch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A wrist watch, comprising a lower case portion of a pot-like shape; a clockwork received in said portion; a watch glass; a seal ring positioned between the watch glass and the lower case portion said lower case portion being provided with a recess which receives said seal ring; and a watch strap having two end portions connected to said lower case portion, said watch glass being held and pressed against said lower case portion directly by said two end portions of the watch strap.

2. The watch as defined in claim 1, wherein said watch glass has two opposite sides and provided at said opposite sides with opposite lateral steps, said two end portions having two respective projections, which are engaged in said lateral steps, respectively.

3. The watch as defined in claim 2, wherein said glass is formed with an opening which constitutes a space for an hour and second hand.

4. The watch as defined in claim 3, wherein the height of each of said lateral steps is the same as the height of said space.

5. The watch as defined in claim 4, wherein said glass is formed of a lower disc and an upper disc positioned on said lower disc and glued thereto.

6. The watch as defined in claim 5, wherein said lower disc is formed with said opening and extends laterally at each said opposite side of the glass beyond said upper disc a distance corresponding to the width of each lateral step.

7. The watch as defined in claim 6, wherein the upper disc and the lower disc of said glass are formed of different materials having different hardnesses.

8. The watch as defined in claim 7, wherein said upper disc is formed of sapphire glass and said lower disc is formed of mineral glass.

9. The watch as defined in claim 7, wherein said upper disc is formed of sapphire glass and said lower disc is formed of metal.

10. The watch as defined in claim 7, wherein each disc of said glass has an underside, the underside of said lower disc being decorated.

11. The watch as defined in claim 7, wherein each disc of said glass has an underside, the underside of said upper disc in the region of its attachment to said lower disc being decorated.

12. The watch as defined in claim 10, wherein the underside of said lower disc being covered with metal.

13. The watch as defined in claim 10, wherein the underside of said lower disc is covered with varnish.

14. The watch as defined in claim 11, wherein the underside of said upper disc in said region is covered with metal.

15. The watch as defined in claim 11, wherein the underside of said upper disc in said region is covered with varnish.

16. The watch as defined in claim 5, wherein said recess is extended up to said space, the watch further including a dial positioned in said recess, said seal ring surrounding said dial, said lower disc having an inner rim overlapping an edge of said dial.

17. The watch as defined in claim 16, further including a crown stem detachably connectable to the clockwork by means of a coupling, and at least two additional seal rings, said lower casing portion including a bore receving said crown stem, said crown stem being guided immediately in said bore and having at least two grooves formed thereon, said additional seal rings being carried by said crown stem at said grooves.

18. The watch as defined in claim 1, wherein said lower case portion is connected to said end portions of the strap by bolts.

* * * * *